US006021571A

United States Patent [19]

Scholte

[11] Patent Number: 6,021,571

[45] Date of Patent: Feb. 8, 2000

[54] APPARATUS FOR FORMING COLLARS IN WORKPIECES

[75] Inventor: Manfred Scholte, Neustadt, Germany

[73] Assignee: Kathrin Witulski, Neustadt, Germany

[21] Appl. No.: 08/804,043

[22] Filed: Feb. 26, 1997

[30] Foreign Application Priority Data

Feb. 27, 1996 [DE] Germany ..... 196 07 311

[51] Int. Cl.[7] ..... B21C 37/29

[52] U.S. Cl. ..... 29/890.148; 29/890.15; 72/370.27; 72/391.2

[58] Field of Search ..... 72/352, 367.1, 72/370.04, 370.11, 370.27, 391.2; 29/890.148, 890.15

[56] References Cited

U.S. PATENT DOCUMENTS

| | | | |
|---|---|---|---|
| 2,368,394 | 1/1945 | Zummach . | |
| 2,507,859 | 5/1950 | Keller | 20/890.15 |
| 4,106,322 | 8/1978 | Moshnin | 29/890.148 |
| 4,178,786 | 12/1979 | Rothenberger . | |
| 4,676,088 | 6/1987 | Okada et al. | 29/890.148 |

FOREIGN PATENT DOCUMENTS

| | | | |
|---|---|---|---|
| 0 322 722 | 12/1988 | European Pat. Off. . | |
| 0322722 | 7/1989 | European Pat. Off. | 29/890.148 |
| 0 672 798 A1 | 9/1995 | European Pat. Off. . | |
| 28 14 176 | 4/1978 | Germany . | |
| 37 44 046C2 | 12/1987 | Germany . | |
| 60-09 519 | 1/1985 | Japan . | |
| 0244422 | 12/1985 | Japan | 29/890.148 |
| 1 478 646 | 9/1974 | United Kingdom . | |

*Primary Examiner*—David Jones
*Attorney, Agent, or Firm*—Shlesinger Arkwright & Garvey, LLP

[57] ABSTRACT

The invention concerns apparatus for forming collars in workpieces, where said apparatus comprises a bending former having an inner forming segment (16) and an outer forming segment (12) receiving a workpiece (96), further a plunger (24) for drawing through the bending former and an actuator (50) for the plunger. The actuator (50) comprises a draw bar (62) driven by a drive means (28) and fitted with a system (52) automatically receiving, locking and unlocking the plunger (24).

9 Claims, 7 Drawing Sheets

APPARATUS FOR FORMING COLLARS IN WORKPIECES

The invention concerns apparatus for forming collars in workpieces, in particular in pipes or pipe branchoffs.

It is known to make such collars in pipes using balls, namely the ball is inserted into the pipe wherein it is then forced, by means of hydraulically driven wedging punches, through a hole cut in the pipe and evincing a lesser diameter than the ball. In this procedure the pipe material is laterally flanged outward to form a collar to which then pipe segments for instance may be affixed. This known apparatus is costly, it operates in complex manner and moreover lacks reliability.

The object of the present invention is to create a novel apparatus for forming collars in workpieces, where said novel apparatus operates in simple and reliable manner.

The invention is elucidated below in relation to the attached drawing showing an illustrative embodiment.

Figure 1:
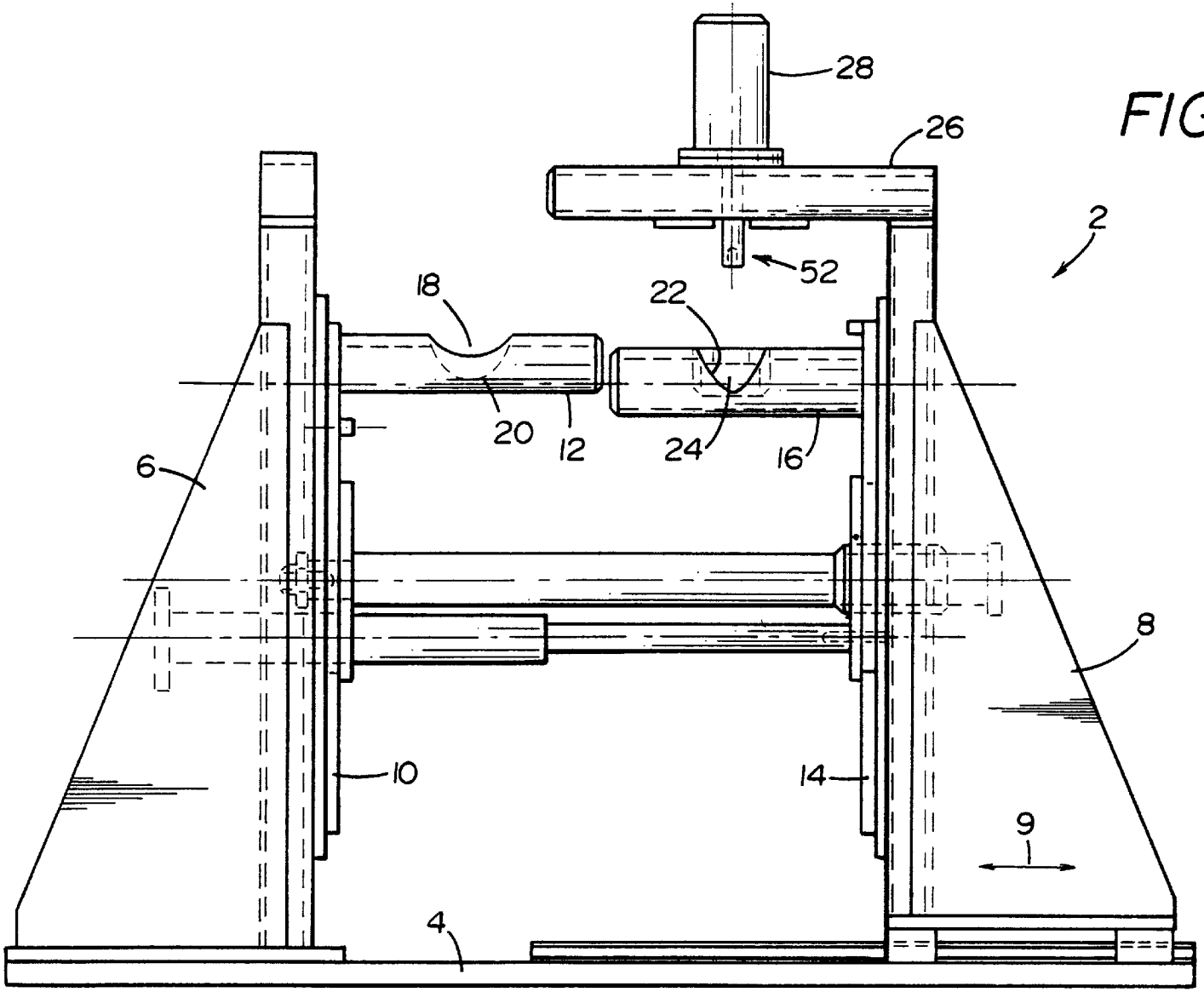
Figure 2:
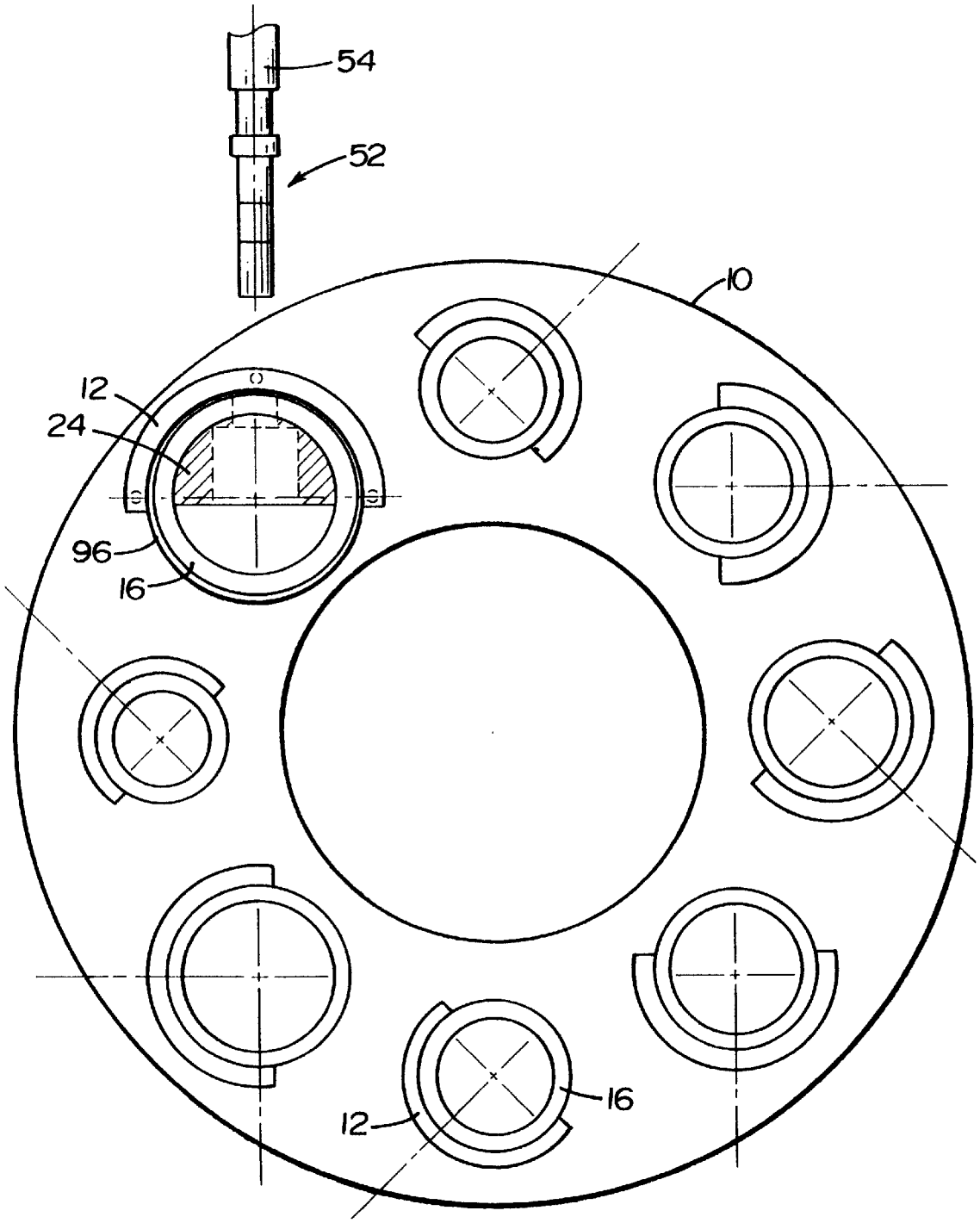
Figure 3A:
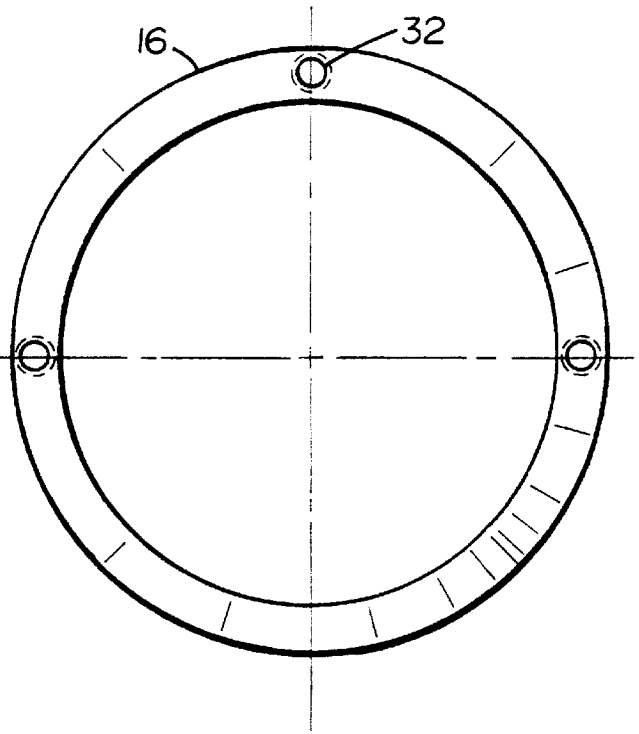
Figure 3B:
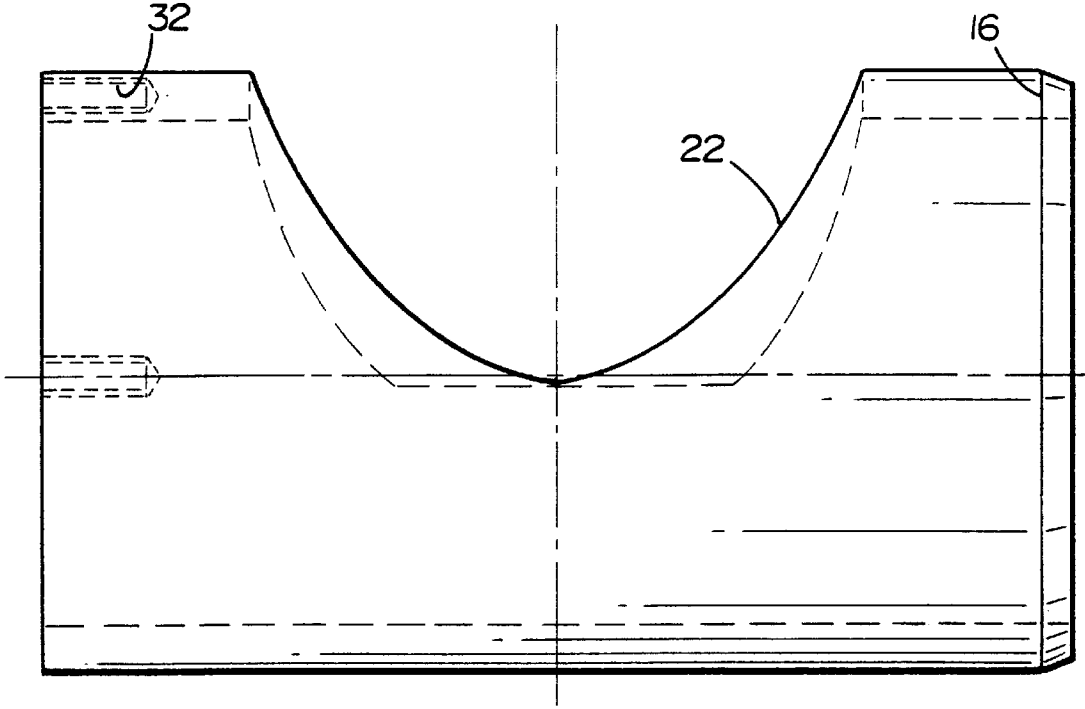
Figure 4A:
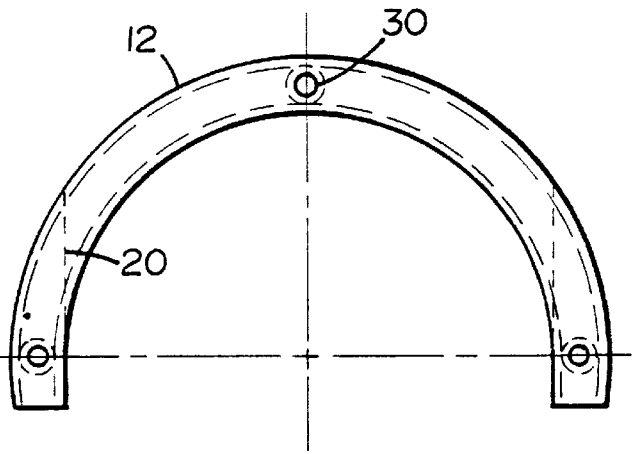
Figure 4B:
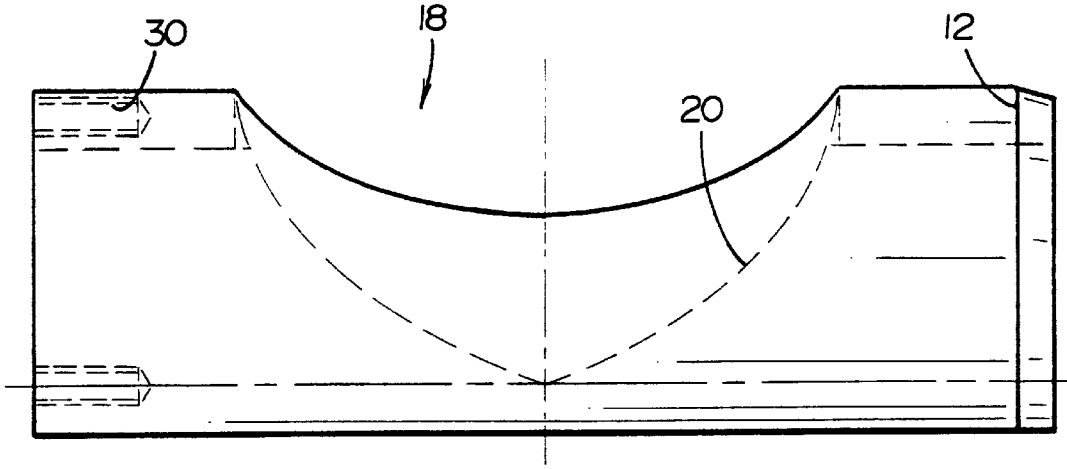
Figure 5B:
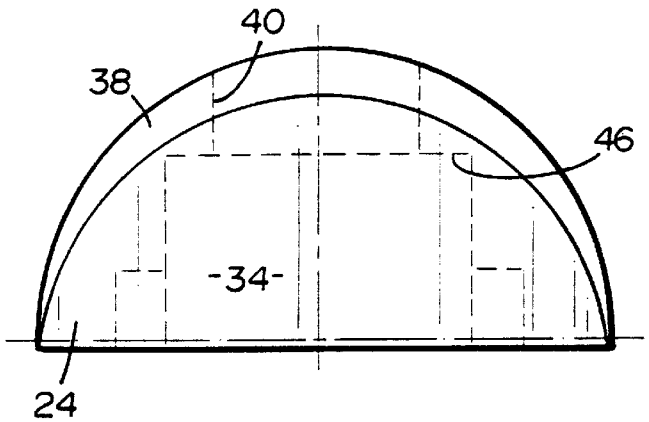
Figure 5A:
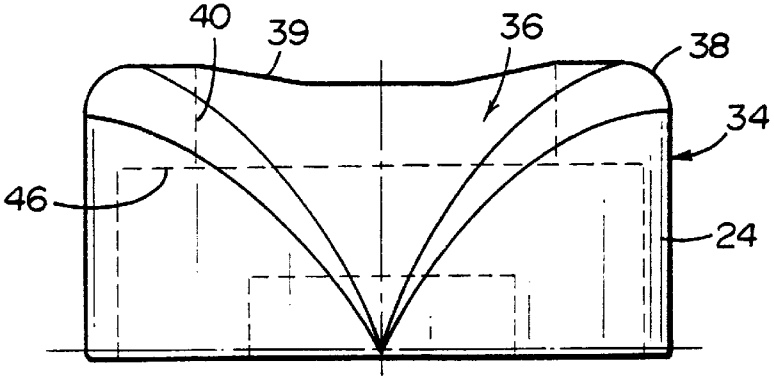
Figure 5C:
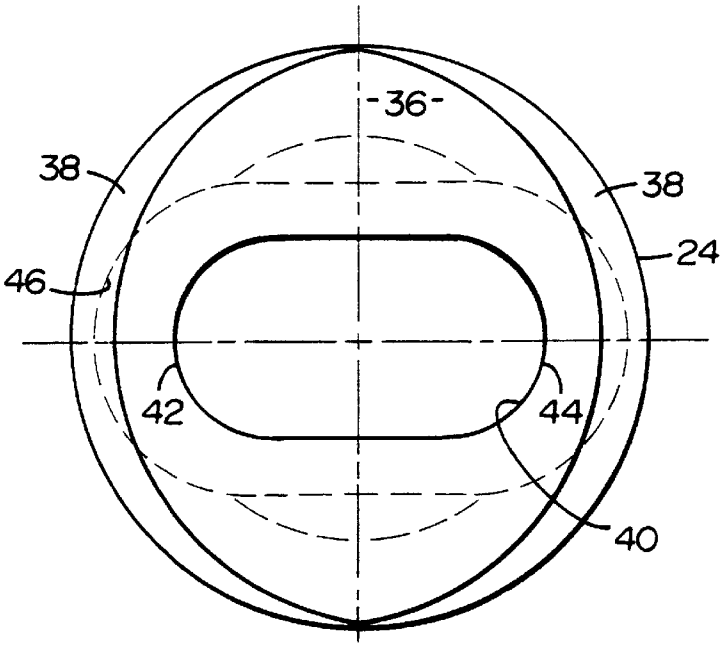
Figure 6A:
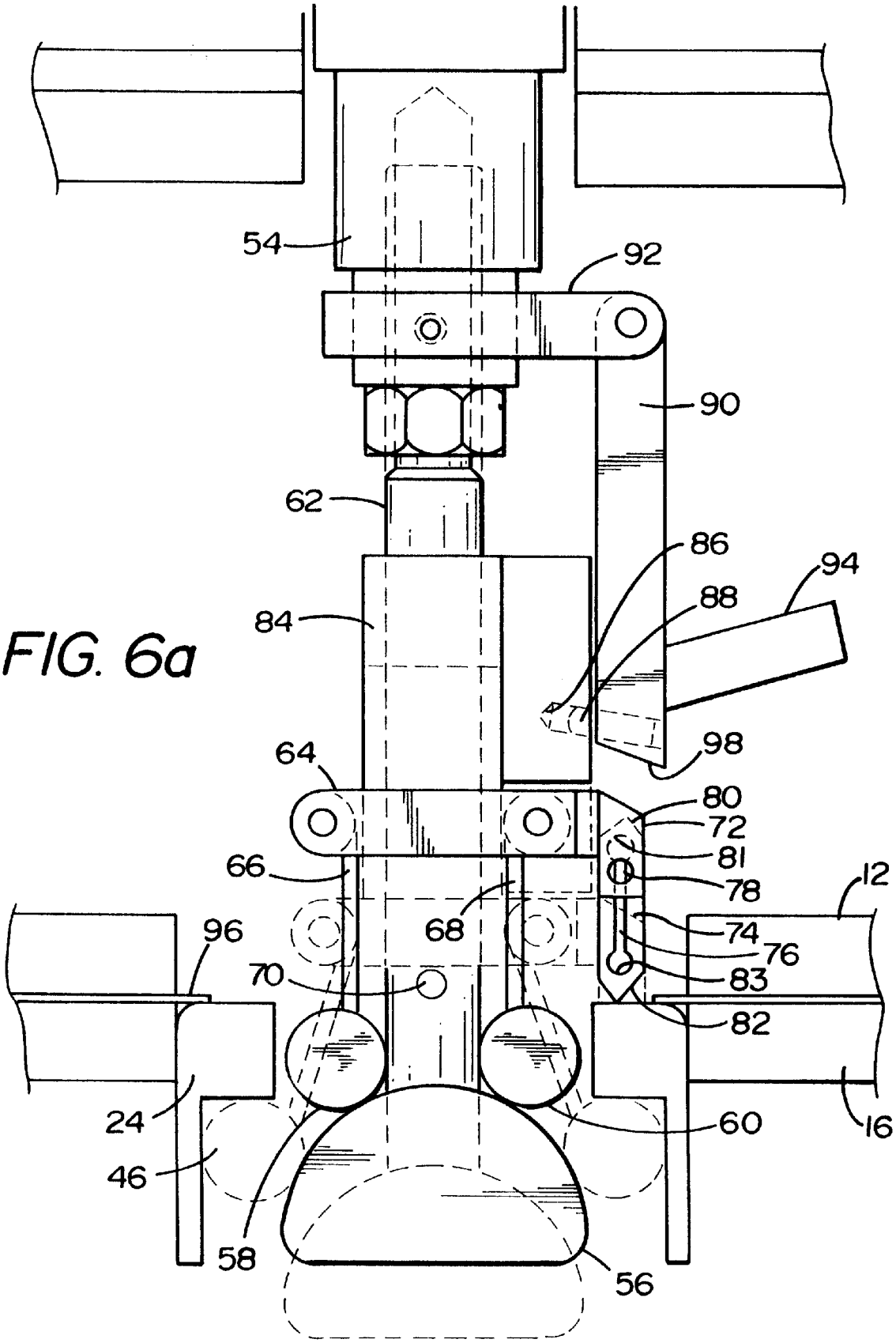
Figure 6B:
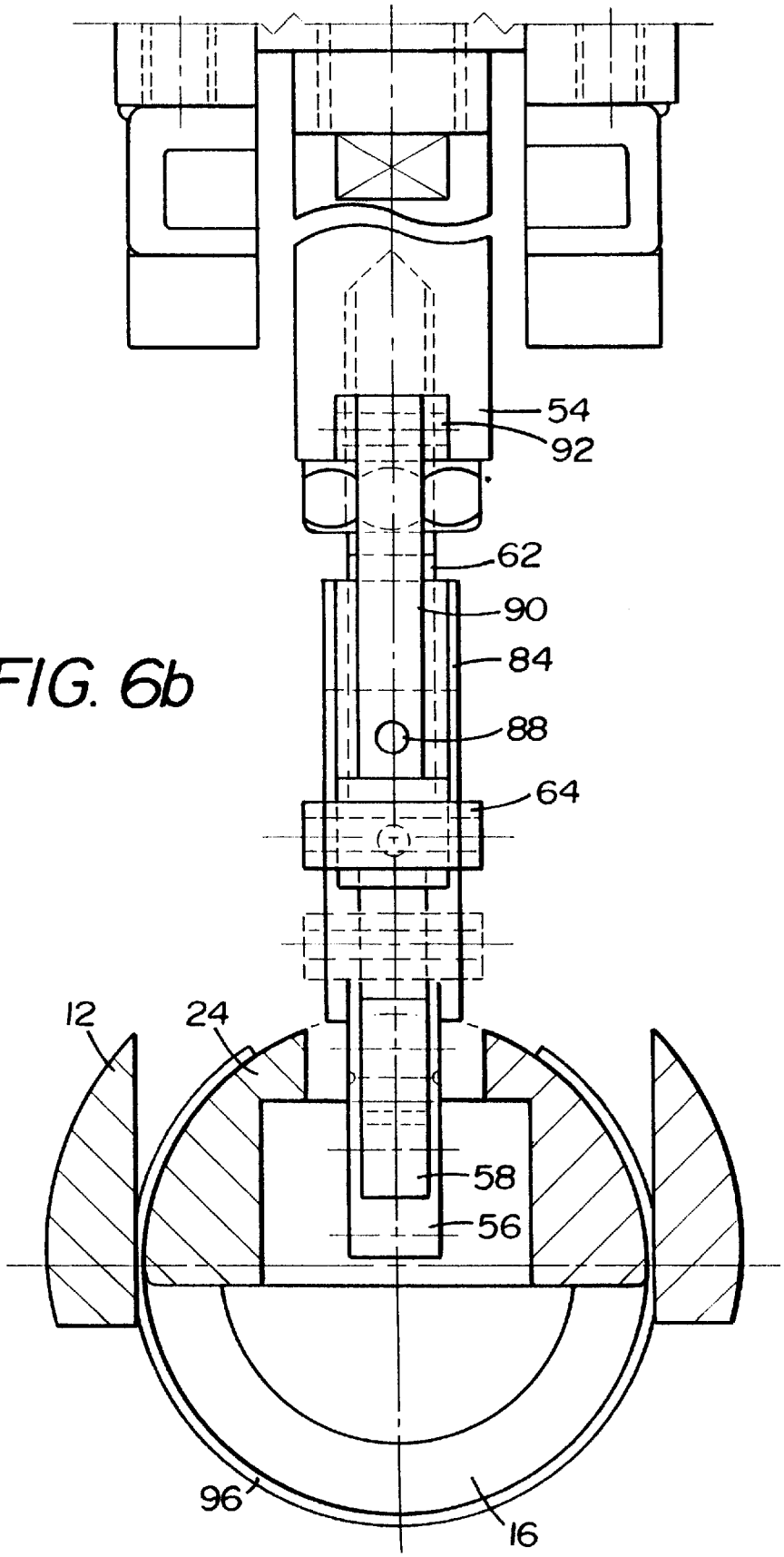

FIG. 1 schematically shows an apparatus forming collars in pipes, with an outer and an inner forming segment being parts of a forming tool, FIG. 2 schematically shows a sideview of a seat used in the apparatus of FIG. 1 receiving several outer forming segments of different sizes, FIGS. 3*a*, 3*b* are resp. a front and a side view of the inner forming segment of the tool of the apparatus of FIG. 1, FIGS. 4*a*, 4*b* resp. are an axial and a side view of the outer forming segment of the tool of the apparatus of FIG. 1, FIGS. 5*a*, 5*b*, 5*c* are resp. a front, a side and a top view of a drawing punch of the tool used in the apparatus of FIG. 1, and FIGS. 6*a*, 6*b* show in partial section a device used in the apparatus of FIG. 5 to drive the drawing punch and fitted with a locking and unlocking system.

Identical components in the Figures of the drawing are denoted by the same references.

The drawing shows a pipe-collar forming apparatus 2 having a base plate 4 onto which a first frame 6 is rigidly affixed and a second frame 8 designed as a carriage is mounted in displaceable manner (arrow 9; FIG. 1). A first and preferably circular plate 10 is rotatably mounted on the first frame 6 and several outer forming segments 12 of different sizes and assuming the shapes of cylindrical shells are arrayed in a circle on said frame 6 (FIG. 2).

A second and preferably circular plate 14 is rotatably mounted on the carriage 8 and several cylindrical inner forming segments 16 associated to the outer forming segments 12 are mounted on said carriage, the outside diameters of the inner forming segments 16 being smaller than the inside diameters of the outer forming segments.

Moreover the outer forming segments 12 and the inner forming segments 16 also may be all identical, or only one outer forming segment and one inner forming segment may be provided.

By moving the carriage 8 to the left in FIG. 1, the inner forming segment 16 can be moved into the cylinder shell of the outer forming segment which is open downward. The outer forming segment is somewhat larger than half a cylinder and comprises a bending hole 18 in the cylinder surface, said hole 18 evincing an inside edge designed as a bending edge 20 (also see FIG. 4) at which the collar will be formed by pulling on a plunger, as elucidated further below.

The inner forming segment 16 also is fitted with a hole in the cylinder surface (FIG. 3) to act as a seat 22 for a plunger 24 which will be used to form a collar on the pipe by being forced against the bending edge 20 of the outer forming segment 12, as further elucidated below.

A beam 26 receiving a hydraulic cylinder 28 is mounted to the carriage 8, said cylinder driving, by means of a device further discussed below, the plunger 24.

In a variation, the outer forming segments may also be rigidly affixed to the carriage and the inner forming segments may be mounted in stationary manner.

The references 30 and 32 denote end-side threaded boreholes in the outer and inner forming segments 12 and 16 resp. to allow affixation by means of omitted screws to the plates 10 and 14.

The plunger 24 is shown in further detail in FIGS. 5*a* through 5*c*. It is designed as a hollow body of which the outer surface is subtended by two equally large cylindrical surfaces 34, 36 which intersect orthogonally, the cylinder surface 34 being vertical and the other surface 36 being horizontal. The intersection edge 38 is rounded as shown in particular in FIG. 5*a*. An elongated slot 40 with arcuate narrow sides 42, 44 is present centrally in the cylindrical top side 39. The elongated slot 40 evinces a peripheral undercut 46. The elongated slot 40 fitted with the undercut 46 receives a locking system omitted from FIGS. 5*a–c* but discussed in relation to FIGS. 6*a* and 6*b*, the plunger height is selected to be equal to or somewhat larger than the radius of the cylinder 36 in order that the collar to be formed shall be accurately circular. The above described plunger 24 offers the advantage that its shape allows uniform distribution of the drawing forces on the tubular workpiece, the plunger resting everywhere against this workpiece. As a result danger of cracks in the material is avoided.

FIGS. 6*a* and 6*b* show the forming tool composed of the inner forming segment 16, the outer forming segment 12 and the plunger 24 when driven by a drive 50.

The drive 50 comprises a locking/unlocking system 52 connected by an adapter 54, or also directly, to a piston rod of the hydraulic cylinder 28.

The locking/unlocking system 52 comprises an upwardly semi-circular planar locking member 56 and two locking elements 58, 60 which, as shown, preferably are circular panes.

The locking member 56 is mounted to a rectangular draw bar 62 connected to the adapter 54 or to the piston rod of the hydraulic cylinder 28, for instance being screwed to them as shown. The locking elements 58, 60 are pendulously suspended by integrated, swinging bars 66, 68 from a retaining member 64. The retaining member 64 is displaceably mounted on the drawbar 62.

A limit pin 70 associated with the draw bar 62 limits downward the excursion of the retaining member 64 on the draw bar 62.

Furthermore an unlocking member 74 is displaceably mounted in a slide guide 72 at the retaining member 64 and comprises a guide slot 76 for a bilaterally flattened guide pin 78 rigidly affixed in the slide guide 72 of the retaining member 64. The unlocking member 74 is fitted with bevels 80, 82 at its top and bottom sides. The guide slot 76 issues at both ends in boreholes 81, 83 having a diameter allowing to rotate the unlocking member 74 around the guide pin 78.

A locking block 84 displaceable along the draw bar 62 is mounted above the retaining member 64 with which it is rigidly joined and evinces a preferably upwardly slanting blind hole 86 receiving a locking pin 88 mounted at the lower end of a locking lever 90 in turn rotatably mounted by its upper end on an arm 92 rigidly joined to the draw bar 62 or the adapter 54. Additionally the lower end of the locking lever 90 may be fitted with a loading weight 94 preferably designed as a grip.

The above described apparatus operates as follows:

Initially, when the frame 6 and the carriage 8 are apart, the plunger 24 is placed over the receiving hole 22 into the cylindrical inner forming segment 16; next a tubular workpiece 96, for instance a V4A chimney pipe which is to receive a shaped collar, is moved over the inner forming segment 16 in such manner that a prefabricated hole in the workpiece 96 is made to lie above the receiving hole 22; thereupon the carriage 8 is displaced to move the outer forming segment 12 over the workpiece 96 and the inner forming segment 16 in such a way that the bending hole 18 of the outer forming segment is flush with the workpiece hole and the plunger of the inner forming segment. This condition is schematically shown in FIGS. 1 and 2.

FIG. 6 shows the apparatus 52 when being partly lowered, that is in the condition wherein the locking member 56 and the locking elements 58, 60 are moved into the plunger 24 to lock onto it. As the hydraulic cylinder 28 is lowered further, the unlocking member 74 comes to rest on the plunger 24 and is guided and displaced upward by the guide pin 78 and moves by its bevel 80 against the slanted underside 98 of the locking lever 90 and on account of the wedge effect of the locking lever 90 will pivot outward, whereby the locking pin 88 moves out of the blind hole 86; as a result the locking block 84 and the retaining member 64 are released and jointly with the locking elements 58, 60 and the guiding pin 78 on the draw bar 62 they drop until resting against the limit pin 70. In the process, the guiding pin 78 arrives into the particular lower hole (in this instance hole 83) of the unlocking member 74 which on account of the slanted lower surface 82 then tips outward by its upper end. Moreover the locking elements 58, 60 on the circular surface of the locking member 56 move outward and underneath the undercut 46 of the elongated slot 40 of the plunger 24. If now the draw rod 62 together with the locking member 56 is displaced upward, this locking member 56 will lock the locking elements 58 and 60 under the undercut 46 as indicated in dashed lines in FIG. 6 for the locking elements. By pulling up further, the plunger 24 is carried along to bend or flange the edge of the hole of the tubular workpiece 96 entering the bending hole 18 of the outer forming segment in order to make a collar.

Following the making of the collar and lifting the plunger 24, the plunger is unlocked by removing the inner forming segment 16 from the workpiece and from the outer forming segment 12 and by moving down the draw rod 62 using the hydraulic cylinder 28 until the plunger 24 still being locked by the locking member 56 and the locking elements 58, 60 comes to rest in the inner forming segment 16 and until, on account of further lowering the draw rod 62 and of the detachment of the locking member 56 from the locking elements 58 and 60 caused by setting the slide guide 72, the locking elements again are able to pivot inward into the position shown in solid lines in FIG. 6*a* and the locking lever 90 is moved down relative to the locking block 84 and, by means of its locking pin 88, automatically enters the blind hole 86 of the locking block 84. This entry is enhanced by the additional weight 94.

Thereupon, by pulling up the draw bar 62, the locking member 56 and the locking elements 58, 60 may be removed from the plunger 24 and from the inner forming segment 16. In the process the end of the unlocking member 74 containing the guide pin 78 is carried along upward by the guide pin 78, the unlocking member 74 automatically pivoting back into the vertical position. Thereupon the apparatus is ready for the next drawing procedure. The described apparatus and in particular the described plunger, advantageously allow making collars of the same diameter as the tubular workpiece. Furthermore the described apparatus allows making two mutually opposite or offset collars which also may have diameters arbitrarily smaller than the diameter of the tubular workpiece.

The described system 52 for locking/unlocking is suitable not only with plungers in the manufacture of pipe collars, but also with plungers used in making collars in other, for instance planar workpieces.

I claim:

1. A forming tool for forming collars in workpieces comprising:

a) a bending former for receiving a workpiece;

b) a plunger operatively associated with said former for drawing said plunger therethrough to bend a workpiece held in said former;

c) an actuator for said plunger, said actuator including a draw bar operatively associated with a drive member; and d) a locking system for receiving, locking and unlocking said plunger to said draw bar, said locking system is mounted on said draw bar and includes a locking block displaceable and lockable on said draw bar and at least one locking element for locking said plunger to said draw bar, said at least one locking element is mounted on said locking block.

2. An Apparatus as claimed in claim 1, and further including:

a) a pendulously rotatable locking lever connected to said draw bar and serving to lock said locking block, a locking borehole extending in said locking block and a locking pin adapted to automatically enter and engage said locking borehole of said locking block, said locking pin is mounted on a free end of said locking lever.

3. An Apparatus as claimed in claim 2, and wherein:

a) said plunger having an undercut and cooperating elongated slot extending therein, said at least one locking element is mounted in a pendulously rotatable manner to said locking block and on at least one side of said draw bar, said draw bar comprises at a lower end thereof a locking member which, together with said at least one locking element can be guided into said undercut and said elongated slot associated with said plunger whereby said locking member allowing to pivot said locking elements under said undercut into a position for locking said plunger to said draw bar.

4. An Apparatus as claimed in claim 3 and wherein:

a) said locking member is a planar component and is at least one of mounted on or integrated in said draw bar end and further comprises two sides that are at least one of arcuate, circular or slanted and extending from said draw bar in a direction of two mutually opposite sides, whereby said two sides are so configured so as to force said at least one locking element to pivot outwardly when said draw bar is pulled up and said locking block is unlocked.

5. An Apparatus as claimed in claim 3, and wherein:

a) said plunger having a cylindrically round upper top side and said elongated slot of said plunger is centrally positioned on cylindrically round upper top side of said plunger.

6. Apparatus as claimed in claim 2, and further comprising:

a) an unlocking member operatively associated with said locking lever, said unlocking member is mounted above said plunger at said locking block and comprises a guide slot and a bilaterally flattened guide pin rigidly affixed to said locking block, said guide slot for guiding said unlocking member along said bilaterally flattened guide pin rigidly affixed to said locking block whereby said unlocking member is displaceable relative to said locking block upon lowering of said draw bar and deposition on said plunger at said guide pin upwardly against an underside surface of said locking lever.

7. An Apparatus as claimed in claim 6, and wherein:

a) said guide pin having a diameter and said guide slot having respective ends, said guide slot ends extend into respective boreholes, each of said respective boreholes having a diameter larger than the maximum diameter of said guide pin.

8. A forming tool for forming collars in workpieces comprising:

a) a bending former for receiving a workpiece;

b) a plunger operatively associated with said former for drawing said plunger therethrough to bend a workpiece held in said former;

c) an actuator for said plunger, said actuator including a draw bar operatively associated with a drive member;

d) a locking system for receiving, locking and unlocking said plunger to said draw bar, said locking system is mounted on said draw bar and includes a locking block displaceable and lockable on said draw bar, said at least one locking element is mounted on said locking block; and e) said plunger comprising a surface of a first cylinder and a surface of an equally sized second cylinder orthogonally intersecting said first cylinder to provide respective intersecting edges, said intersecting edges of said cylinders are rounded.

9. A forming tool for forming collars in workpieces comprising:

a) a bending former for receiving a workpiece and a plunger operatively associated with said former for drawing said plunger therethrough to bend a workpiece held in said former, said bending former comprising a cylindrical inner forming segment having a passageway for receiving said plunger, the tubular workpiece to be processed is displaceable over said inner forming segment, and a cooperating downwardly open outer forming segment having a radius thickness at least larger in an amount of thickness than that of the tubular workpiece to be processed, said outer forming segment is fitted with a bending hole cooperating with said plunger and having an inside surface functioning as a bending edge, said outer forming segment is displaceable over said inner forming segment and the workpiece to be processed;

b) an actuator for said plunger, said actuator including a draw bar operatively associated with a drive member;

c) a locking system for receiving, locking and unlocking said plunger to said draw bar, said locking system is mounted on said draw bar and includes a locking block displaceable and lockable on said draw bar and at least one locking element for locking said plunger to said draw bar, said at least one locking element is mounting on said locking block; and d) rotating plates having said inner forming segments and said outer forming segments mounted mutually opposite each other thereon and at least one of said rotating plates being displaceably mounted on a movable carriage.

* * * * *